US010995533B2

(12) United States Patent
Wörner

(10) Patent No.: US 10,995,533 B2
(45) Date of Patent: May 4, 2021

(54) HYDRAULIC DRIVE FOR A DOOR SASH OR WINDOW SASH

(71) Applicant: GEZE GmbH, Leonberg (DE)

(72) Inventor: Benjamin Wörner, Korntal-Münchingen (DE)

(73) Assignee: GEZE GMBH, Leonberg (DE)

( * ) Notice: Subject to any disclaimer, the term of this patent is extended or adjusted under 35 U.S.C. 154(b) by 0 days.

(21) Appl. No.: 16/447,532

(22) Filed: Jun. 20, 2019

(65) Prior Publication Data

US 2019/0390498 A1 Dec. 26, 2019

(30) Foreign Application Priority Data

Jun. 25, 2018 (DE) ..... 10 2018 210 278.3

(51) Int. Cl.
*E05F 3/00* (2006.01)
*E05F 3/22* (2006.01)
(Continued)

(52) U.S. Cl.
CPC ..... *E05F 3/223* (2013.01); *E05F 3/10* (2013.01); *E05F 15/50* (2015.01); *E05Y 2900/132* (2013.01)

(58) Field of Classification Search
CPC . Y10T 16/577; Y10T 16/2804; Y10T 16/285; Y10T 16/293; Y10T 16/585;
(Continued)

(56) References Cited

U.S. PATENT DOCUMENTS 2,790,991 A * 5/1957 Schlage ..... E05F 3/102 16/62
3,822,438 A * 7/1974 Takenaka ..... E05F 3/102 16/62
(Continued)

FOREIGN PATENT DOCUMENTS

DE 10325202 A1 1/2005
DE 102016208099 A1 11/2017
(Continued)

OTHER PUBLICATIONS

Search and Examination Report issued in connection with United Kingdom Application No. GB1908662.8 dated Dec. 9, 2019.

*Primary Examiner* — Chuck Y Mah
(74) *Attorney, Agent, or Firm* — Steven M. Shape; Dennemeyer & Associates, LLC

(57) ABSTRACT

A hydraulic drive for a sash of a door, a gate, a window or the like comprises a housing and a piston which is displaceably guided in the housing and which divides the interior of the housing into a pressure chamber and a non-pressurized chamber. In this case, the drive, which can in particular be a hydraulic door closer, comprises a regulating valve which is arranged on the end face of the housing delimiting the pressure chamber on the side facing away from the piston and which is integrated in particular in a housing cover for activating an impact function. The regulating valve has a valve member which is displaceable between a closed position and an open position in a valve bore of a valve housing formed in particular by the housing cover, is impinged on in the closing direction by the pressure in the pressure chamber and can be transferred into the open position thereof by the spring force of a spring unit when the pressure in the pressure chamber falls below a predeterminable limit pressure.

16 Claims, 9 Drawing Sheets

(51) Int. Cl.
*E05F 3/10* (2006.01)
*E05F 15/50* (2015.01)

(58) Field of Classification Search
CPC ..... Y10T 16/299; Y10T 16/286; Y10T 16/27; Y10T 16/2774; Y10T 16/2777; Y10T 16/56; Y10T 16/552; E05F 3/02; E05F 3/10; E05F 3/12; E05F 3/104; E05F 3/102; E05F 3/22; E05F 3/221; E05F 3/223; E05F 3/225; E05F 3/227; E05F 15/50; E05F 15/47; E05F 15/483; E05Y 2900/132; E05Y 2201/618; E05Y 2201/716; E05Y 2201/722
See application file for complete search history.

(56) References Cited

U.S. PATENT DOCUMENTS 4,048,694 A * 9/1977 Newman ..... E05F 3/12 16/52
4,050,114 A * 9/1977 Zunkel ..... E05F 3/223 16/48.5
4,349,939 A * 9/1982 Tillmann ..... E05F 3/104 16/53
4,386,446 A * 6/1983 Zunkel ..... E05F 3/12 16/58
4,580,365 A * 4/1986 Sieg ..... E05F 3/102 49/336
4,658,468 A * 4/1987 Tillmann ..... E05F 3/104 16/53
4,660,250 A * 4/1987 Tillman ..... E05F 1/006 16/58
4,793,023 A * 12/1988 Simpson ..... E05F 3/12 16/52
4,995,194 A * 2/1991 Schultze ..... E05F 3/04 16/58
5,259,090 A * 11/1993 Fayngersh ..... E05F 3/102 16/52
5,502,874 A * 4/1996 Lucas ..... E05F 3/102 16/52
5,535,514 A * 7/1996 Lucas ..... E05F 3/102 16/62
5,709,009 A * 1/1998 Lasson ..... A62C 2/241 16/48.5
6,151,753 A * 11/2000 Salutzki ..... E05F 3/10 16/49
8,806,715 B2 * 8/2014 Bienek ..... F16K 31/0627 16/53
9,790,723 B2 * 10/2017 Bienek ..... E05F 3/10
2003/0213092 A1 * 11/2003 Fischbach ..... E05F 15/42 16/52
2004/0074145 A1 * 4/2004 Homberg ..... E05F 3/12 49/64
2004/0205930 A1 * 10/2004 Huang ..... E05F 3/00 16/64
2007/0033768 A1 * 2/2007 Ginzel ..... E05F 3/04 16/71
2009/0320236 A1 * 12/2009 Yamamuro ..... E05F 3/102 16/64

FOREIGN PATENT DOCUMENTS

GB 736891 A * 9/1955 ..... E05F 15/53
GB 888854 A * 2/1962 ..... E05F 3/102
JP 08226274 A * 9/1996 ..... E05F 3/102
JP 2001049946 A 2/2001

* cited by examiner

Fig. 2b
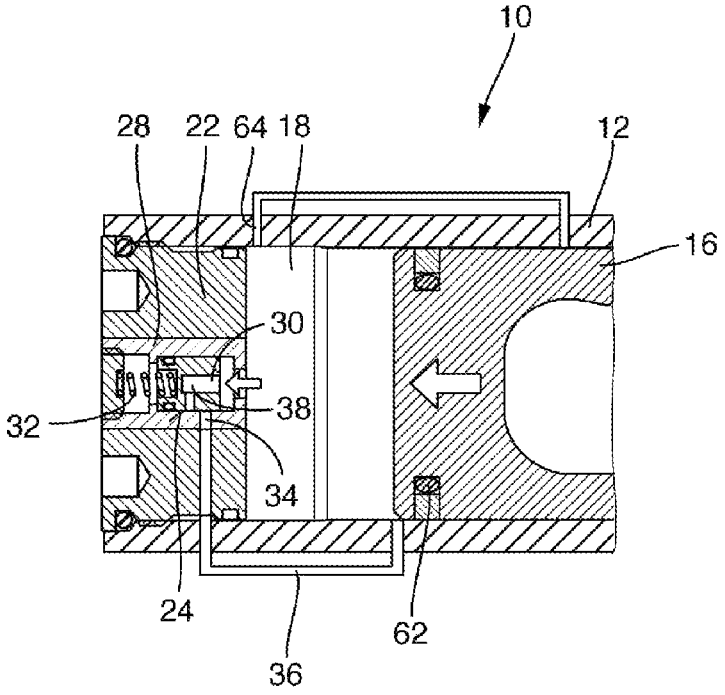
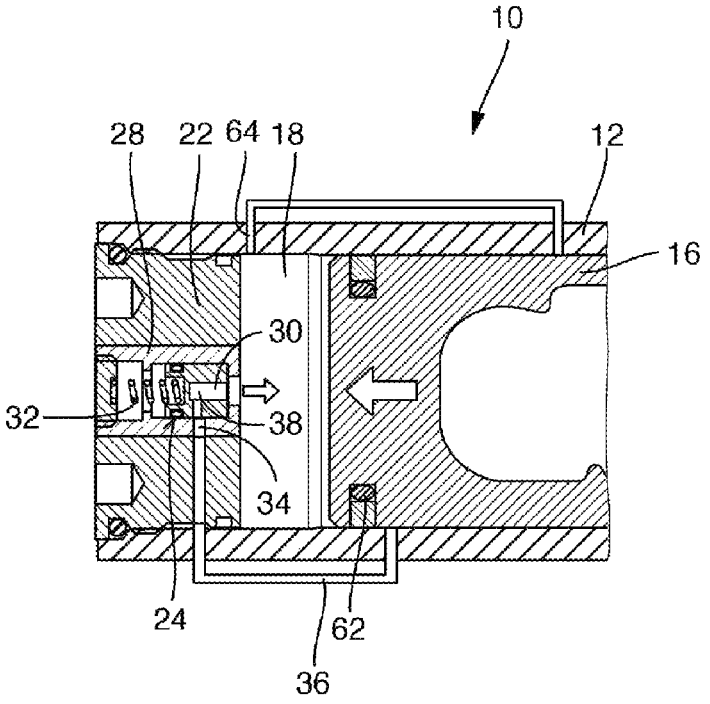
Fig. 2d

HYDRAULIC DRIVE FOR A DOOR SASH OR WINDOW SASH

CROSS-REFERENCE TO RELATED APPLICATIONS

This application claims priority to German application 102018210278.3, filed Jun. 25, 2018, which is hereby incorporated by reference in its entirety.

BACKGROUND OF THE INVENTION

The invention relates to a hydraulic drive for a sash of a door, a gate, a window or the like, having a housing and a piston which is displaceably guided in the housing and divides the interior of the housing into a pressure chamber and a non-pressurized chamber. In this case, the hydraulic drive can in particular be a door closer.

Hydraulic door closers are generally known and bring about the autonomous closing of a door, wherein both the movement of the door leaf into the door frame and the dropping of the lock latch of the door lock into the lock plate is guaranteed. In each case, closing which is as controlled as possible should be ensured. Such a door closer usually comprises an output shaft, a piston that is connected via a gear to the output shaft and guided in a housing, and at least one spring interacting with the piston, wherein on opposite sides of the piston, a pressure chamber or a non-pressurized chamber are provided and hydraulic fluid via can be transferred during a closing procedure via at least one regulating valve from the pressure chamber into the non-pressurized chamber. In the case of manual opening of the sash or, for example, automatic opening of the sash which is effected by a hydraulic pump, the spring arranged in the housing that is filled with a hydraulic fluid is compressed by displacement of the piston in such a way that it can act as an energy storage device for autonomous closing of the sash. Between the chambers of the housing that are separated from one another by the piston, hydraulic channels having associated regulating valves are arranged, via which the overflow of hydraulic fluid for controlling the drive behaviour can be influenced.

In hydraulically damped door closers, the pressurized hydraulic fluid is throttled by means of one or more regulating valves. A so-called impact function, in the case of such hydraulically damped door closers when they are activated, allows an undamped closing of the door by short-circuiting the damping circuit. This so-called impact region is often also adjustable by a regulating valve, i.e. throttled again.

By means of an end stop function, a door can thus be accelerated during closing shortly before reaching the closed position so that reliable closing of the door is made possible. Such an end stop function is required particularly in the case of opposing forces acting on the door, such as a draft, an overpressure and/or an air cushion in enclosed spaces or the like. However, these may only occur temporarily. If there are no opposing forces, the door is accelerated too strongly by the end stop function so that it strikes too hard, which is accompanied by corresponding noise and can lead to damage.

A disadvantage of the hitherto known hydraulically damped door closers is particularly that the impact function can only be rigidly set, for example during commissioning. Randomly occurring resistances on the door cannot be overcome when the stroke is deactivated. On the other hand, if the stroke is set for wind load, the door starts to strike loudly without wind load.

The aim of the invention is to provide a hydraulic door, gate or window drive of the type in question in which the above-mentioned disadvantages have been eliminated. In particular, a more variable activation of the impact function of a door, gate or window drive that is more optimally adjustable to the circumstances should be guaranteed.

According to the invention, this aim is achieved by a hydraulic drive for a sash of a door, a gate, a window or the like having the features of claim 1. Preferred embodiments of the drive according to the invention result from the dependent claims, the present description and the drawing.

The hydraulic drive according to the invention for a sash of a door, a gate, a window or the like, which can be in particular a hydraulic door closer, comprises a housing and a piston which is displaceably guided in the housing and divides the interior of the housing into a pressure chamber and a non-pressurized chamber. In this case, the drive comprises a regulating valve which is arranged on the end face of the housing delimiting the pressure chamber on the side facing away from the piston, is integrated in particular in a housing cover for activating an impact function and has a valve member that is displaceable between a closed position and an open position in a valve bore of a valve housing formed in particular by the housing cover, wherein pressure in the pressure chamber impinges on said valve member in the closing direction and said valve member can be transferred into its open position by the spring force of a spring unit when the pressure in the pressure chamber falls below a predeterminable limit pressure.

The solution according to the invention provides an intelligent impact or end stop function which is integrated in the hydraulic drive, preferably in a housing cover, and which is only activated as necessary, i.e. only when opposing forces acting on the sash occur, in order to guarantee reliable closing of the sash in the case of such opposing forces, whereas it is deactivated in the absence of opposing forces so that in the normal case no noise disturbance or striking of the sash can occur. Since the pressure in the pressure chamber acts on the valve member of the regulating valve, this pressure in front of the piston of the drive can be detected by the regulating valve and thus the relevant state of the drive can be detected. The regulating valve can thus also be referred to as a sensor valve. By this regulating valve, the impact function is also activated and deactivated according to the state of the drive.

The principle underlying the solution according to the invention is based on the fact that the pressure in the pressure chamber or in front of the piston of the drive and thus the pressure in front of the regulating valve drops as soon as the sash is externally delayed or braked. The regulating or safety valve detects this condition and activates the impact function of the hydraulic drive when the pressure in the pressure chamber falls below the limiting pressure by displacing the valve member into its open position by means of the spring unit associated therewith. The regulating valve is thus opened so that the damping circuit is short-circuited. The sash in question now also closes in the case of unexpectedly occurring resistances such as, for example, a stiff latch, sporadically occurring, not excessively strong wind and/or lock situations with an air cushion to be overcome. On the other hand, if the pressure prevailing in the pressure chamber of the drive during a normal closing operation is above the limit pressure, the spring unit impinging on the valve member of the regulating valve cannot overcome the force applied by the pressure in the pressure chamber. The valve member of the regulating valve in this case assumes its closed position so that the regulating valve is closed. The impact function is thereby disabled.

The solution according to the invention thus guarantees in particular a more variable activation of the impact function of a door, gate or window drive that is more optimally adjustable to the circumstances.

Preferably, the regulating valve and thus the impact function is integrated in a housing cover of the drive. With such an integration of the impact function in a housing cover, this can be inserted in a modular manner.

The valve member of the regulating valve can in particular be provided in the form of a locking sleeve.

Advantageously, a passage to an outflow channel for a hydraulic medium can be closed or released by the valve member of the regulating valve. In this case, the passage to the outflow channel preferably opens into the valve bore of the regulating valve.

The outflow channel is expediently positioned such that the impact function can only be activated at sash opening angles which are less than a predetermined value, in particular less than 15°. In this case, the outflow channel from the closing sash is passed over by the piston of the drive only at the predetermined sash opening angle or at 15° and thus released by the piston.

There can also be atmospheric pressure on the side of the valve member of the regulating valve which faces away from the pressure chamber and on which the spring unit impinges.

According to an expedient practical embodiment of the drive according to the invention, the valve member of the regulating valve provided in particular in the form of a locking sleeve forms a fit with the valve housing to form a slide valve. By displacing the valve member or locking sleeve into the closed position, in particular a passage to the outflow channel which opens into the valve bore of the regulating valve can thus be closed.

In this case, the valve member of the regulating valve is preferably provided with an overflow channel for the hydraulic medium, which opens with one end into the pressure chamber and with its other end in particular into a recess which extends at least over a part of the periphery of the valve member and which, when the valve member assumes its closed position, is positioned for interrupting the connection with the passage to the outflow channel in a region outside the passage and, when the valve member assumes its open position, is positioned for producing a connection with the passage to the outflow channel in the region of the passage.

Since the seal of a slider sealing seat is dependent on the quality of the fit or the interacting surfaces, the sealing gap, etc. and can often have slight base leakage, the valve housing according to an alternative advantageous embodiment of the drive according to the invention can also be provided with a conical sealing seat, with which the valve member interacts via a conical or spherical sealing surface.

In this case, play between the interacting surfaces is automatically compensated by centring the interacting components so that the sealing seat is virtually free of leaks. In addition, the components in the present case are cheaper to produce.

According to a further alternative advantageous embodiment of the drive according to the invention, the valve member of the regulating valve can be provided with a sealing element, such as an O-ring or the like, which, when the valve member assumes its closed position, seals with the valve housing via a flat sealing seat.

According to a preferred practical embodiment of the drive according to the invention, the limit pressure, from which the valve member of the regulating valve is transferable by the spring force of the spring unit impinging on the valve member into its open position when there is a corresponding drop in the pressure in the pressure chamber, in particular the valve member is variably adjustable via the biasing force of the spring unit impinging on the valve member of the regulating valve in the opening direction.

Here, the limit pressure or the biasing force of the spring unit impinging on the valve member in the opening direction is advantageously variably adjustable via an actuator that is adjustable in particular by a thread.

With lower biasing forces of the spring unit impinging on the valve member of the regulating valve, the valve member can only be transferred into its open position at a correspondingly lower counter-pressure or correspondingly steeper drop in pressure in the pressure chamber. With higher biasing forces, on the other hand, the valve member can be transferred into its open position even at a correspondingly higher counter-pressure or lower pressure drop in the pressure chamber of the drive. In the latter case, therefore, a lower counter-pressure acting on the sash is required to trigger the impact function. The system thereby reacts more sensitively.

The response pressure of the system can be regulated or adjusted via the actuator.

In certain cases, it is advantageous if the spring unit impinging on the valve member of the regulating valve in the opening direction is arranged on the side facing away from the pressure chamber or behind the valve member. Thus, the drive can be kept relatively compact in diameter.

With higher counter-pressures impinging on the valve member of the regulating valve, i.e. higher pressures in the pressure chamber, it is also possible for the spring unit impinging on the valve member of the regulating valve to still generate too little spring force in the case of a smallest structurally possible pressure application surface. In particular, in such a case, according to a further preferred practical embodiment of the drive according to the invention, a spring plate having a diameter which is larger in relation to the diameter of the valve member can be arranged on the side of the valve member of the regulating valve facing away from the pressure chamber and the spring unit impinging on the valve member in the opening direction can rest with its end facing the valve member on the spring plate. Thus, the spring unit can in particular comprise a compression spring having an enlarged periphery, via which higher spring forces can also be generated.

It is particularly advantageous if the spring plate is designed as a spring cup guided via the valve housing.

With such a spring cup guided via the valve housing, a straight application of force is ensured from the spring plate to the valve member. The valve member can neither tilt nor jam, so the functional reliability of the drive is increased accordingly.

According to a further advantageous practical embodiment of the drive according to the invention, the spring unit impinging on the valve member of the regulating valve in the opening direction is at least partially accommodated in the valve member that is provided particularly in the form of a locking sleeve.

Thus, the drive can be kept relatively compact in its length.

BRIEF DESCRIPTION OF THE DRAWINGS

The invention is explained in more detail below on the basis of exemplary embodiments and with reference to the drawings.

FIG. 1 shows a schematic longitudinal sectional representation of the basic structure of an exemplary embodiment of a hydraulic drive according to the invention for a sash of a door, a gate, a window or the like.

FIG. 2*b*) shows an enlarged sectional representation of the hydraulic drive according to FIG. 1 in a phase in which the sash is already closed again, the valve member of the regulating valve assumes its closed position and the outflow channel is blocked by the piston seal so that the impact function cannot yet be activated.

FIG. 2*d*) shows an enlarged sectional partial representation of the hydraulic drive according to FIG. 1 in a phase in which the sash has already been closed so far that the sash opening angle is smaller than the predetermined value of, for example, 15° and the seal of the piston has passed over the outflow channel so that the impact function can be activated, but wherein the sash in the present case is not braked by opposing forces and the valve member of the regulating valve has thus transferred by the associated spring unit into its open position so that the impact function is now activated.

DETAILED DESCRIPTION

Figure 1:
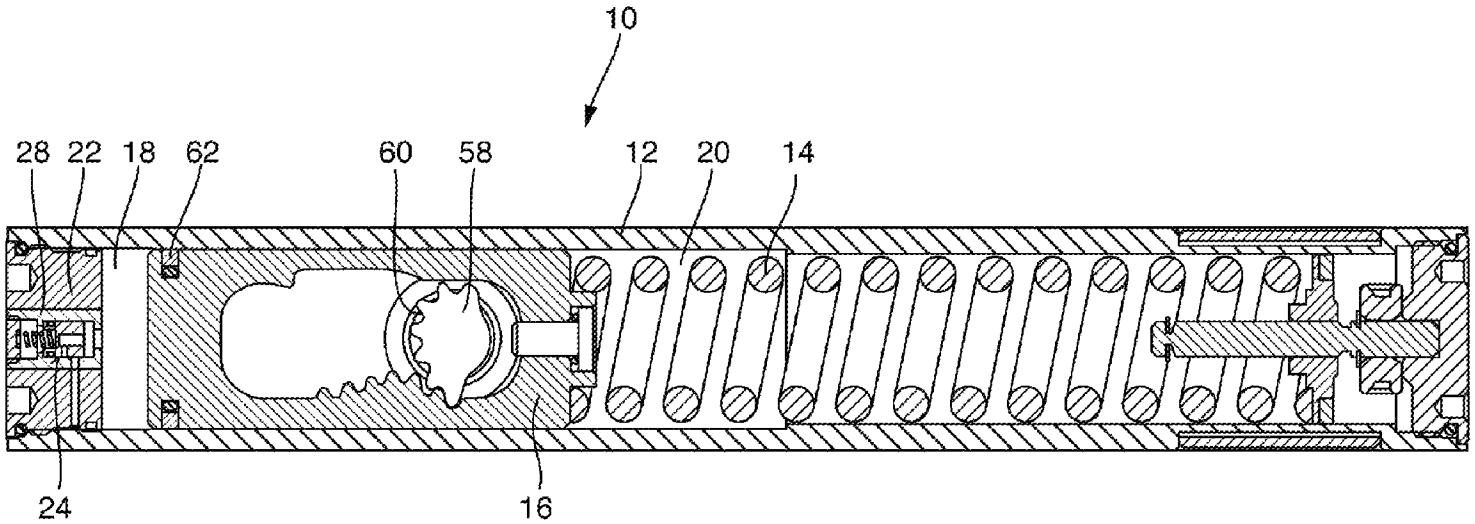

FIGS. 1 to 15 show exemplary embodiments of a hydraulic drive 10 according to the invention for a sash of a door, a gate, a window or the like. In this case, the hydraulic drive 10 can in particular be a hydraulic door closer.

The hydraulic drive 10 in each case comprises a housing 12 and a piston 16, which is displaceably guided in the housing 12 and impinged on by a spring unit 14, in particular a compression spring, said piston dividing the interior of the housing 12 into a pressure chamber 18 and a non-pressurized chamber 20. In addition, a drive 10 comprises a regulating valve 24, which is arranged on the end face of the housing 12 delimiting the pressure chamber 18 on the side facing away from the piston 16 and is in particular integrated in a housing cover 22, said regulating valve for activating an impact function.

The regulating valve 24 has a valve member 30 that is displaceable between a closed position and an open position in a valve bore 26 of a valve housing 28 formed in particular by the housing cover 22, wherein pressure in the pressure chamber 18 impinges on said valve member in the closing direction and said valve member can be transferred into its open position by the spring force of a spring unit 32 when the pressure in the pressure chamber 18 falls below a predeterminable limit pressure.

In the present embodiments, the valve member 30 of a regulating valve 24 is provided, for example, in the form of a locking sleeve. A passage 34 to an outflow channel 36 which opens into the valve bore 26 of the regulating valve 24 can be closed or released for a hydraulic medium in each case by the valve member 30.

The outflow channel 34 is positioned such that the impact function can only be activated at sash opening angles which are less than a predetermined value, in particular less than 15°.

There may also be atmospheric pressure at the side of the valve member 30 of the regulating valve 24 which faces away from the pressure chamber 18 and is impinged by the spring unit 32.

As can be seen from FIGS. 1 to 4, the valve member 30 of the regulating valve 24 provided in particular in the form of a locking sleeve can form a fit with the valve housing 28 to form a slide valve.

In these embodiments shown in FIGS. 1 to 4 of the drive 10, the valve member 30 of the regulating valve 24 is provided with an overflow channel 38 for the hydraulic medium, which opens with one end into the pressure chamber 18 and with its other end in particular into a recess 40 which extends at least over a part of the periphery of the valve member 30 and which, when the valve member 30 assumes its closed position, is positioned for interrupting the connection with the passage 34 to the outflow channel 36 in a region outside the passage 34 and, when the valve member 30 assumes its open position, is positioned for producing a connection with the passage 34 to the outflow channel 36 in the region of the passage 34.

Figure 5:
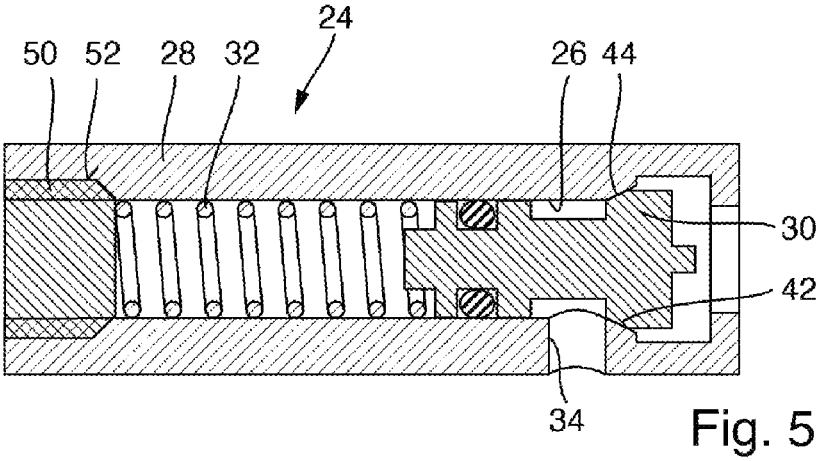
FIG. 5 shows a schematic representation of a further exemplary embodiment of the regulating valve of the drive according to the invention, wherein the valve housing is provided with a conical sealing seat, with which the valve member interacts via a conical sealing surface, wherein the valve member assumes its closed position and blocks the passage to the outflow channel.
Figure 6:
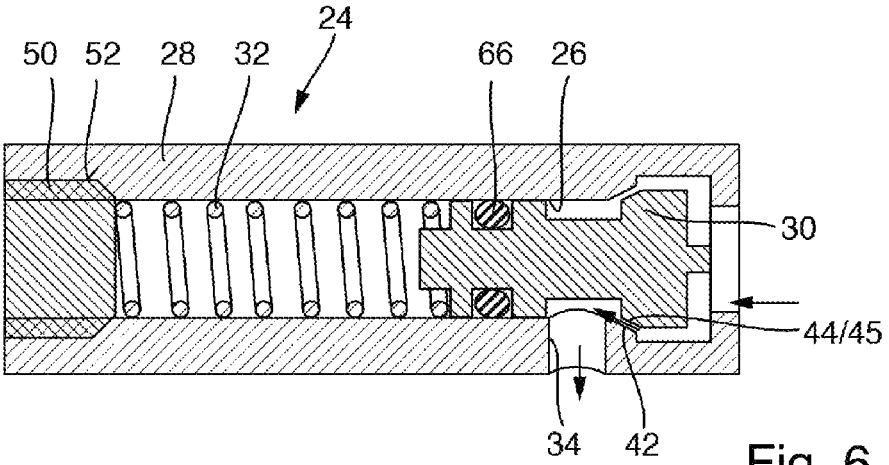
FIG. 6 shows a schematic representation of another exemplary embodiment of the regulating valve of the drive according to the invention, wherein the valve housing is again provided with a conical sealing seat, but the valve member can interact with the conical sealing seat of the valve housing either via a conical or a spherical sealing surface and the valve member assumes its open position and releases the passage to the outflow channel.
Figure 7:
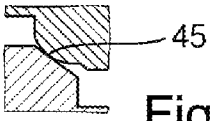
FIG. 7 shows a schematic enlarged partial representation of a seal comprising a conical sealing seat of the valve housing and a spherical sealing surface of the valve member of the embodiment according to FIG. 6.

As can be seen from FIGS. 5 to 7, the valve housing can also be provided with a conical sealing seat 42, with which the valve member 30 interacts via a conical or spherical sealing surface 44 and 45.

In the embodiment according to FIG. 5, the valve housing 28 is provided with a conical sealing seat 42, with which the valve member 30 interacts via a conical sealing surface 44. The valve member 30 here assumes its closed position, so the passage 34 to the outflow channel 36 is blocked.

FIG. 6 shows a further exemplary embodiment of the regulating valve 24 of the drive 10 according to the invention, in which the valve housing 28 is again provided with a conical sealing seat 42. However, the valve member 30 here can interact either via a conical or a spherical sealing surface 44, 45 (see also FIG. 7) with the conical sealing seat 42 of the valve housing 28. In the present case, the valve member 30 assumes its open position, so the passage 34 to the outflow channel 36 is released.

In FIG. 7, the enlarged partial representation shows the seal, comprising the conical sealing seat 42 of the valve housing 28 and a spherical sealing surface 45 of the valve member 30, of the embodiment according to FIG. 6.

As can be seen in particular from FIGS. 8 to 15, the valve member 30 of the regulating valve 24 can in particular also be provided with a sealing element 46, for example an O-ring, which, when the valve member 30 assumes its closed position, seals with the valve housing 28 via a flat sealing seat 48.

In the embodiments according to FIGS. 2 to 4, 8 and 9, the spring unit 32 impinging on the valve member 30 in the opening direction is at least partially accommodated in the valve member 30, so the system can be kept compact in its length.

By contrast, in the embodiments illustrated in FIGS. 5 to 7 and 10 to 13, the spring unit 32 impinging on the valve member 30 is arranged on the side of the valve member 30 facing away from the pressure chamber 18 or behind the valve member 30. In this case, the drive 10 can be kept relatively compact in diameter by a correspondingly smaller diameter of the spring unit 32.

Figure 12:
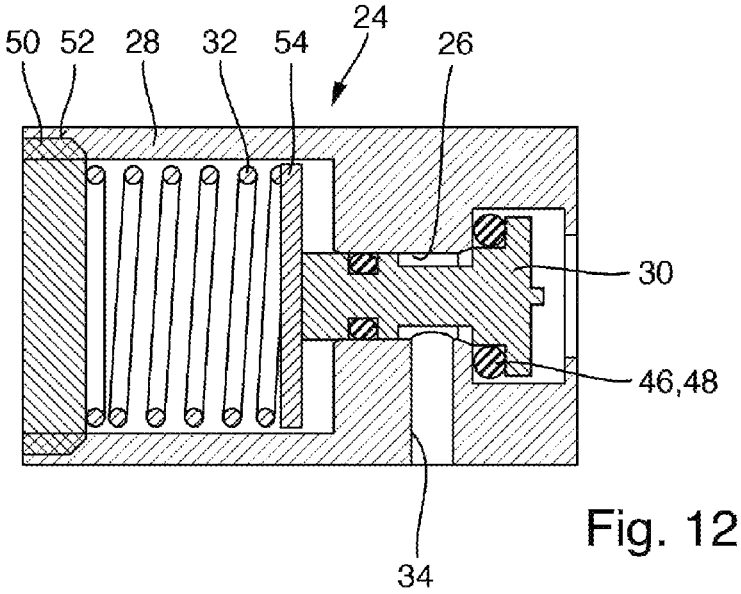
FIG. 12 shows a schematic representation of another exemplary embodiment of the regulating valve of the drive according to the invention, in which on the side of the valve member facing away from the pressure chamber a spring plate having a larger diameter in relation to the diameter of the valve member is arranged, on which the spring unit impinging on the valve member in the opening direction rests, wherein the valve member assumes its closed position and blocks the passage to the outflow channel.
Figure 13:
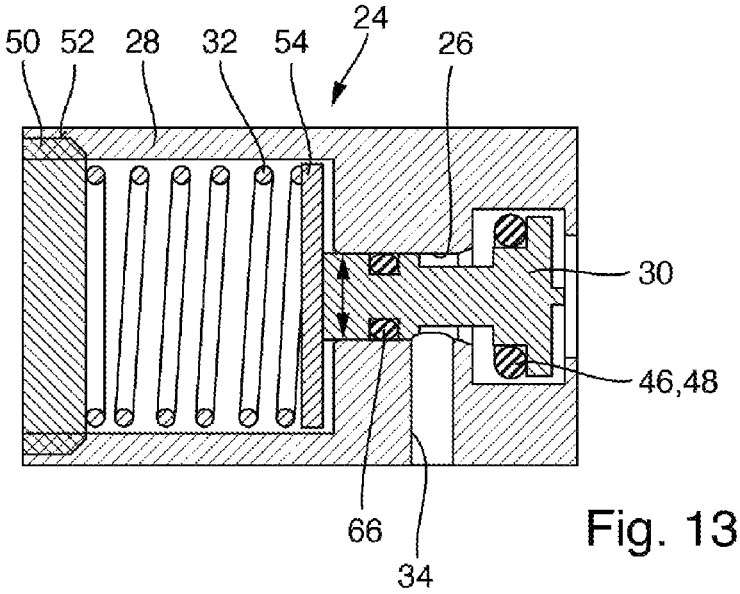
FIG. 13 shows a schematic representation of the regulating valve according to FIG. 12, wherein, however, the valve member assumes its open position and releases the passage to the outflow channel.

As can be seen from FIGS. 12 and 13, a spring plate 54 having a diameter which is larger in relation to the diameter of the valve member 30 can be arranged on the side of the valve member 30 of the regulating valve 24 facing away from the pressure chamber 18 and the spring unit 32 impinging on the valve member 30 in the opening direction can rest with its end facing the valve member 30 on the spring plate 54 so that, as can be seen from FIGS. 12 and 13, the spring unit 32 impinging on the valve member 30 via the spring plate 54 can be provided with a correspondingly large diameter.

Figure 14:
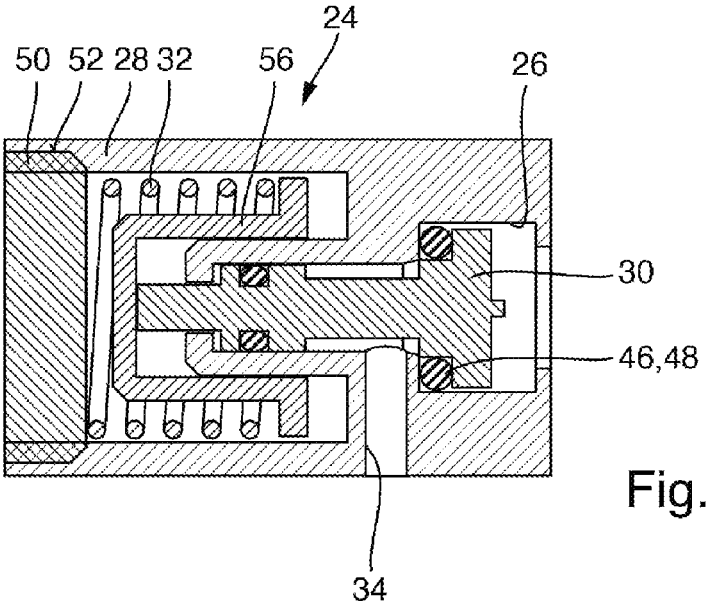
FIG. 14 shows a schematic representation of an exemplary variation of the regulating valve according to FIGS. 12 and 13, in which the spring plate is designed as a spring cup guided via the valve housing, wherein the valve member assumes its closed position and blocks the passage to the outflow channel.
Figure 15:
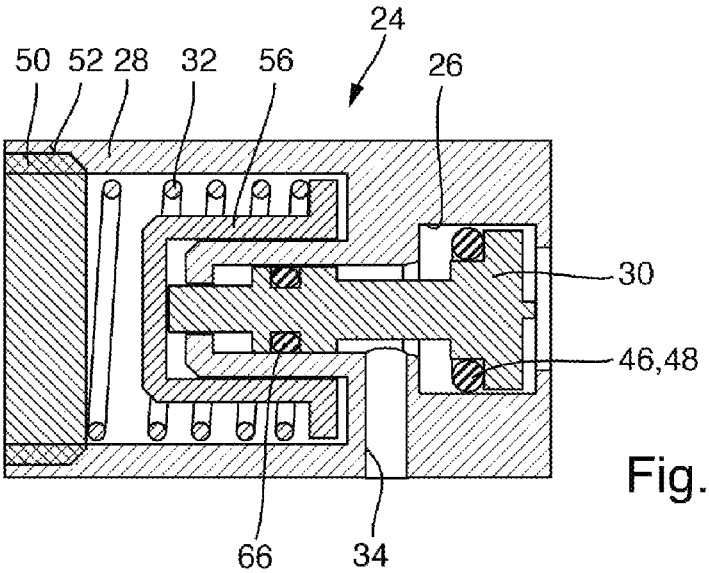
FIG. 15 shows a schematic representation of the regulating valve according to FIG. 14, wherein, however, the valve member assumes its open position and releases the passage to the outflow channel.

In the exemplary variation shown in FIGS. 14 and 15 of the drive 10 shown in FIGS. 12 and 13, the spring plate 54 is designed as a spring cup 56 guided over the valve housing 28.

In the various exemplary embodiments of the drive 10 according to the invention, the limit pressure or the biasing force of the spring unit 32 impinging on the valve member 30 in the opening direction is variably adjustable via an actuator 52 that is adjustable in particular by a thread 50.

As can be seen in particular from FIG. 1, when the sash is opened, an output shaft 58 with the associated pinion 60 is rotated and the piston 16 in the housing 12 is axially displaced against the spring unit 14. In order to control the closing speed when the sash closes, the piston 16 displaces the hydraulic medium through valves associated with different regions. With an activation of the impact or end stop function, the damping circuit is short-circuited. The intelligent impact or end stop function according to the invention can thus be integrated in particular into the housing cover 22 and can thus be used modularly.

Figure 2A:
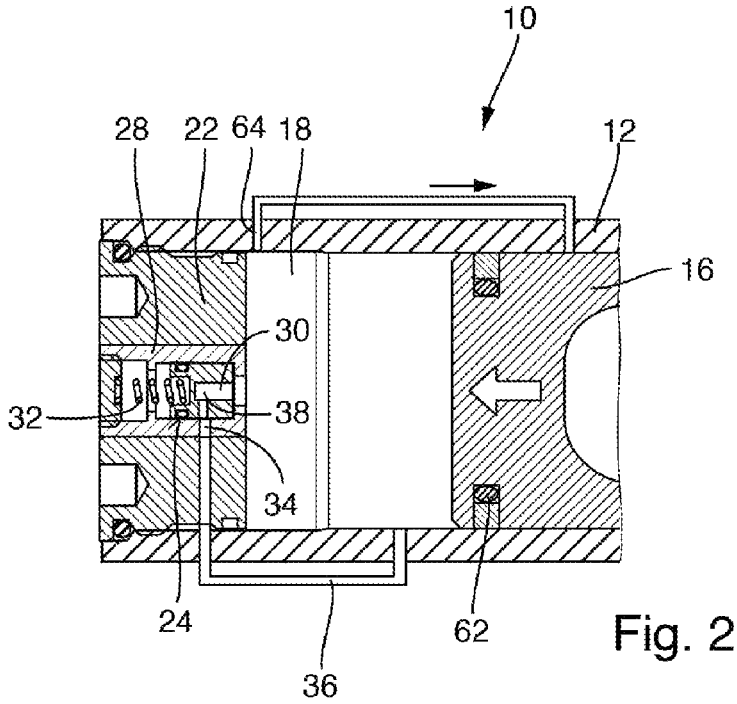
FIG. 2*a*) shows an enlarged sectional partial representation of the hydraulic drive according to FIG. 1 in a phase in which the sash is closed, wherein the sash opening angle is still relatively large, the valve member of the regulating valve still assumes its open position and the outflow channel has not yet been passed over by the piston seal provided in the region of the end of the piston facing the pressure chamber so that the impact function cannot yet be activated despite the valve member assuming its open position.

FIG. 2*a*) shows the hydraulic drive according to FIG. 1 in a phase in which the sash is closed, wherein the sash opening angle is still relatively large, the valve member 30 of the regulating valve 24 still assumes its open position and the outflow channel 36 has not yet been passed over by the seal 62 of the piston 16, so the impact function cannot yet be activated despite the valve member 30 assuming its open position.

FIG. 2*b*) shows the drive according to FIG. 1 in a phase in which the sash is already closed again, the valve member 30 of the regulating valve 24 assumes its closed position and the outflow channel 36 is blocked by the seal 62 of the piston 16, so the impact function still cannot be activated.

Figure 2C:
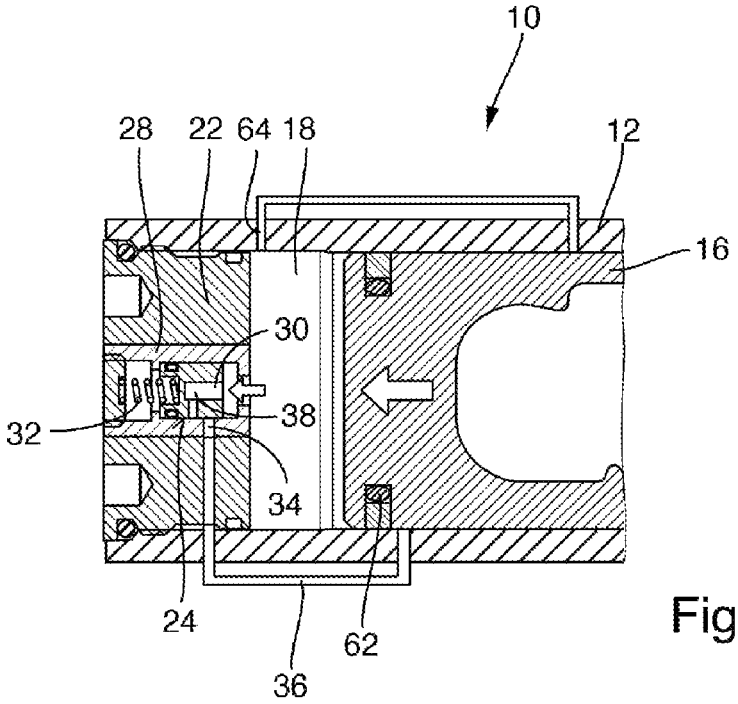
FIG. 2*c*) is an enlarged sectional representation of the hydraulic drive according to FIG. 1 in a phase in which the sash has already been closed so far that the sash opening angle is smaller than a predetermined value of, for example, 15° and the piston seal has passed over the outflow channel so that the impact function can be activated, but wherein the sash is not braked by opposing forces and the valve member of the regulating valve thus maintains its closed position so that the impact function is deactivated.

In the phase, shown in FIG. 2*c*, of the drive 10 according to FIG. 1, the sash has already been closed so far that the sash opening angle is smaller than the predetermined value of, for example, 15° and the seal 62 of the piston 16 has passed over the outflow channel 36, so the impact function can be activated. In this case, however, the sash in the present case is not braked by opposing forces, so the regulating valve 24 maintains its closed position and the impact function is deactivated. If, on the other hand, the sash is braked by opposing forces, the valve member 30 of the regulating valve 24 is transferred into its open position by the associated spring unit 32 as a result of the fallen pressure in the pressure chamber 18, as result of which the impact function is activated (see FIG. 2*d*). The sash can now continue undamped, absorb more kinetic energy and thus reliably close against the external influences. In this case, the position of the outflow channel 36 in the present case is, for example, selected such that the end stop can only be active at sash opening angles <15° as soon as the piston seal 62 has passed over the outflow channel 36.

Figure 3:
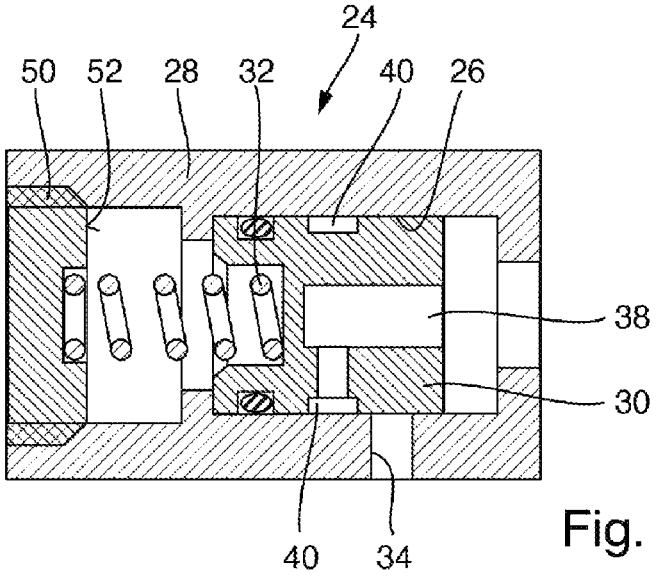
FIG. 3 shows a schematic representation of an exemplary embodiment of the regulating valve of the drive according to the invention, in which the valve member forms a fit with the valve housing to form a slide valve, wherein the valve member assumes its closed position and blocks the passage to the outflow channel.
Figure 4:
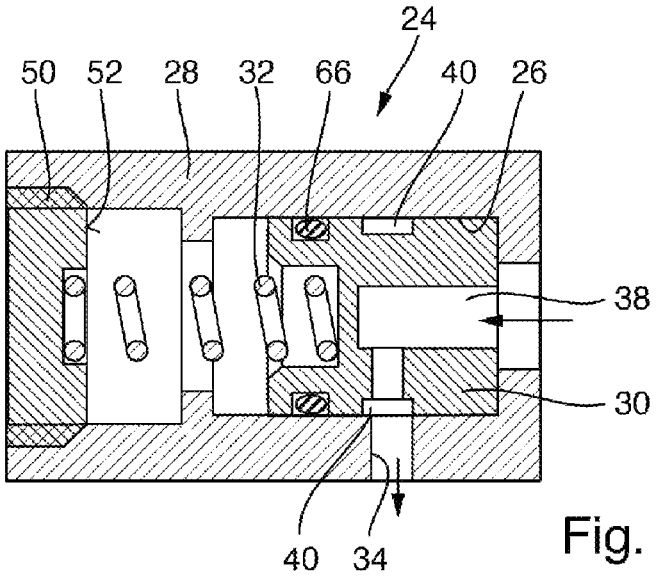
FIG. 4 shows a schematic representation of the regulating valve according to FIG. 3, wherein the valve member, however, assumes its open position and releases the passage to the outflow channel.

In the representations according to FIGS. 3 and 4, the valve member 30 forms a fit with the valve housing 28 to form a slide valve, wherein the valve member 30 in the representation according to FIG. 3 assumes its closed position and blocks the passage 34 to the outflow channel 36, while it assumes its open position in the representation according to FIG. 3 and releases the passage 34. The passage 34 can thus be blocked or released by displacing the valve member 30. The bias of the spring unit 32 and thus the limit pressure can be adjusted via the actuator 52. With lower biasing forces, the valve member 30 provided in particular in the form of a locking sleeve can only be transferred into its open position by the spring unit 32 at a lower counter-pressure or correspondingly steeper drop in pressure in the pressure chamber 18. In contrast, when there are higher biasing forces, the valve member 30 can be transferred into its open position even in the case of a higher counter-pressure in the pressure chamber or damping chamber 18 or in the case of a lower pressure drop in the pressure chamber 18. In the latter case, therefore, a lower counterforce impinging on the sash is required to trigger the impact function. The system reacts accordingly more sensitively.

The response pressure of the system can thus be regulated via the actuator 52.

Unlike a slider sealing seat, as is provided in the embodiment according to FIGS. 3 and 4, the quality of the seal in the embodiments shown in FIGS. 5 to 7, in which the valve housing 28 is provided with a conical sealing seat 42 and the valve member 30 is provided with a conical or spherical sealing surface 44 or 45 interacting with the conical sealing seat 42 of the valve housing 28, is not dependent on the quality of a fit. Possible play between the sealing surfaces is automatically compensated by automatically centring the components, so the sealing seat is virtually free of leakage. In addition, the components in question are cheaper to produce.

The spring unit 32 impinging on the valve member 30 is arranged here on the side facing away from the pressure chamber 18 or behind the valve member 30, so the system can be kept compact in diameter.

Whereas in the representations according to FIGS. 3 and 5, the valve member 30 in each case assumes its closed position and blocks the passage 34 to the outflow channel 36, the valve member 30 in the representations according to FIGS. 4 and 6 in each case assumes its open position so that it releases the passage 34 to the outflow channel 36.

Figure 8:
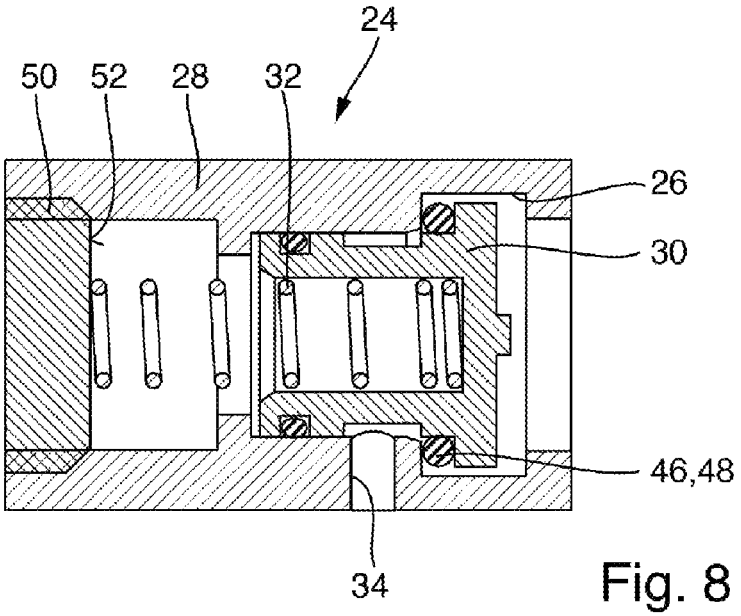
FIG. 8 shows a schematic representation of another exemplary embodiment of the regulating valve of the drive according to the invention, in which the valve member is provided with a sealing element which seals with the valve housing via a flat sealing seat when the valve housing assumes its closed position, and the spring unit impinging on the valve member is accommodated at least partially in the valve member provided in the form of a locking sleeve, wherein the valve member assumes its closed position and blocks the passage to the outflow channel.
Figure 9:
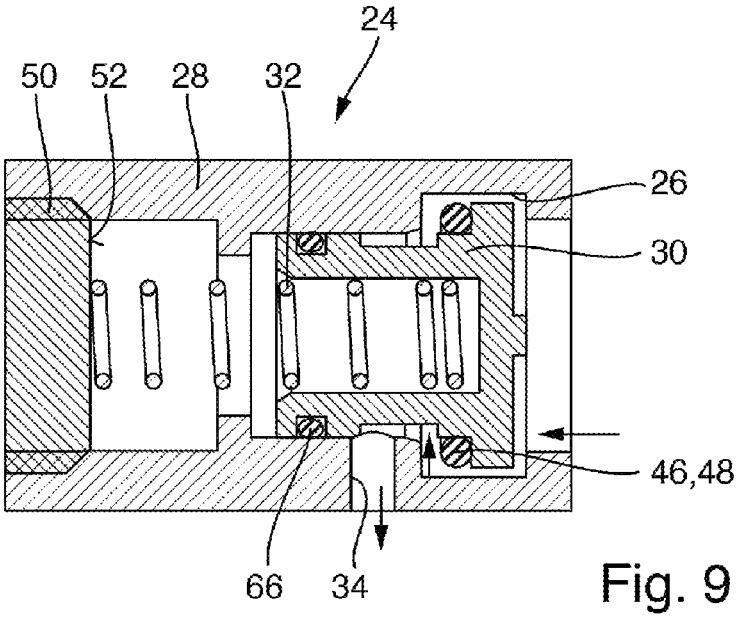
FIG. 9 shows a schematic representation of the regulating valve according to FIG. 8, wherein, however, the valve member assumes its open position and releases the passage to the outflow channel.

As with the embodiment provided with a slider sealing seat seal according to FIGS. 3 and 4, in the embodiment with the flat sealing seat seal shown in FIGS. 8 and 9, the spring unit 32 impinging on the valve member 30 is accommodated at least partially in the valve member 30, so the system can be kept compact in its length.

Figure 10:
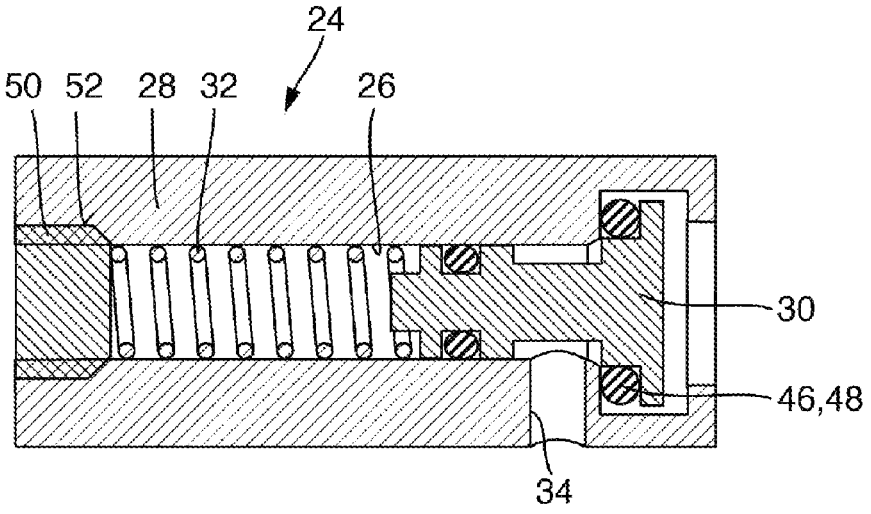
FIG. 10 shows a schematic representation of another exemplary embodiment of the regulating valve of the drive according to the invention, in which the valve member is provided with a sealing element which seals with the valve housing via a flat sealing seat when the valve member assumes its closed position, wherein the spring unit impinging on the valve member, however, is arranged on the side of the valve member facing away from the pressure chamber, wherein the valve member assumes its closed position and blocks the passage to the outflow channel.
Figure 11:
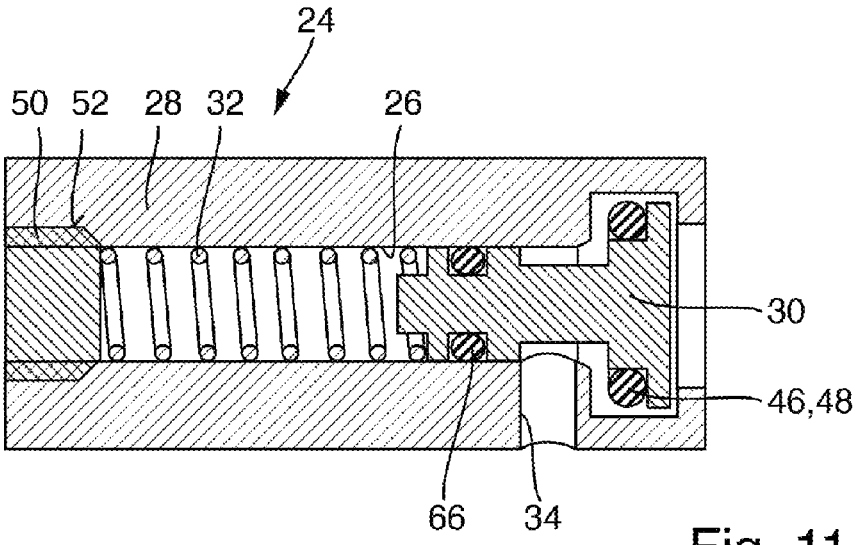
FIG. 11 shows a schematic representation of the regulating valve according to FIG. 10, wherein, however, the valve member assumes its open position and releases the passage to the outflow channel.

By contrast, with the embodiment provided with a flat sealing seat shown in FIGS. 10 and 11, the spring unit 32 impinging on the valve member 30 is arranged on the side of the valve member 30 facing away from the pressure chamber 18 or behind the valve member 30 so that the drive 10 in this case can be kept relatively compact in diameter.

In the embodiment, shown in FIGS. 12 and 13, of the drive with a spring plate 54 provided on the side of the valve member 30 facing away from the pressure chamber 18, the spring unit 32 resting on the spring plate 54 has a diameter corresponding at least substantially to the diameter of the spring plate 54. In the present case, therefore, a correspondingly larger or more strongly dimensioned spring unit 32, in particular a compression spring, can be provided, which may be required in the case of high counter-pressures in the pressure chamber 18 if too small spring force is generated in the case of a smallest structurally possible pressure application surface of the spring unit.

With the embodiment of the drive 10 shown in FIGS. 14 and 15, in which the spring plate 54 is designed as a spring cup 56 guided over the valve housing 12, a straight application of force can be realised from the spring plate 54 to the valve member 30. Tilting and/or jamming of the valve member 30 is thus precluded, as a result of which functional reliability is increased accordingly.

Whereas the valve member 30 assumes its closed position in the representations according to FIGS. 8, 10, 12 and 14 and blocks the passage 34 to the outflow channel 36, in the representations according to FIGS. 9, 11, 13 and 15 it assumes its open position, in which it releases the passage 34 to the outflow channel 36.

As can be seen in particular from FIG. 2, at least one further hydraulic channel 64 can be provided. In such a hydraulic channel 64, for example, a throttle valve can be arranged for the closing time.

In addition, the valve member 30 can be sealed in relation to the valve housing 28 using at least one sealing element 66 such as, for example, a sealing ring.

As already stated, any combinations of the various embodiments of the hydraulic drive 10 according to the invention are also conceivable.

| List of reference signs | |
|---|---|
| 10 | Hydraulic drive |
| 12 | Housing |
| 14 | Spring unit |
| 16 | Piston |
| 18 | Pressure chamber |
| 20 | Non-pressurized chamber |
| 22 | Housing cover |
| 24 | Regulating valve |
| 26 | Valve bore |
| 28 | Valve housing |
| 30 | Valve member |
| 32 | Spring unit |
| 34 | Passage |
| 36 | Outflow channel |
| 38 | Overflow channel |
| 40 | Recess |
| 42 | Conical sealing seat |
| 44 | Conical sealing surface |
| 45 | Spherical sealing surface |
| 46 | Sealing element |
| 48 | Flat sealing seat |
| 50 | Thread |
| 52 | Actuator |
| 54 | Spring plate |
| 56 | Spring cup |
| 58 | Output shaft |

-continued

| List of reference signs | |
|---|---|
| 60 | Pinion |
| 62 | Piston seal |
| 64 | Hydraulic channel |
| 66 | Sealing element |

The invention claimed is:

1. A hydraulic drive (10) for a sash of a door, comprising:

a housing (12);

a piston (16) displaceably positioned in the housing (12), the piston dividing an interior of the housing (12) into a pressure chamber (18) and a non-pressurized chamber (20);

a regulating valve (24) arranged on a first end face of the housing (12) delimiting the pressure chamber (18) on a first side facing away from the piston (16), the regulating valve (24) integrated in a housing cover (22) for activating an impact function and having a valve member (30) displaceable between a closed position and an open position in a valve bore (26) of a valve housing (28) formed by the housing cover (22), the regulating valve (24) impinged on in a closing direction by pressure in the pressure chamber (18) and is transferable into the open position thereof by a spring force of a spring unit (32) when the pressure in the pressure chamber (18) falls below a limit pressure.

2. The hydraulic drive according to claim 1, wherein the valve member (30) includes a locking sleeve.

3. The hydraulic drive according to claim 1, wherein the valve member (30) is configured to open or close a passage (34) to an outflow channel (36) for a hydraulic medium.

4. The hydraulic drive according to claim 3, wherein the passage (34) to the outflow channel (36) opens into the valve bore (26).

5. The hydraulic drive according to claim 3, wherein the outflow channel (34) is positioned such that the impact function is activated at a sash opening angle less than a predetermined value.

6. The hydraulic drive according to claim 1, wherein the spring unit is configured to impinge on an atmospheric pressure on a side of the valve member (30) facing away from the pressure chamber (18).

7. The hydraulic drive according to claim 1, wherein the valve member (30) includes a locking sleeve forming a fit with the valve housing (28) to form a slide valve.

8. The hydraulic drive according to claim 7, wherein the valve member (30) includes an overflow channel (38) for a hydraulic medium, which opens the valve member (30) configured to open with a first end positioned into the pressure chamber (18) a second end opposing the first end positioned into a recess (40) extending over at least a portion of a periphery of the valve member (30) and when the valve member (30) is positioned in the closed position, is positioned for interrupting communication between the passage (34) and the outflow channel (36) in a region outside the passage (34) and, when the valve member (30) is positioned in the open position, is positioned for providing communication between the passage (34) and the outflow channel (36) in the region of the passage (34).

9. The hydraulic drive according to claim 1, wherein the valve housing (28) includes a conical sealing seat (42), the conical sealing seat configured to interact with the valve member (30) via one of a conical sealing surface or a spherical sealing surface.

10. The hydraulic drive according to claim 1, wherein the valve member (30) includes a sealing element (46), the sealing element (46) configured to sealingly engage with the valve housing (28) via a flat sealing seat (48) when the valve member (30) is positioned in the closed position.

11. The hydraulic drive according to claim 1, wherein a limit pressure is variably adjustable via a biasing force of the spring unit (32) impinging on the valve member (30) in an opening direction.

12. The hydraulic drive according to claim 11, wherein the limit pressure or the biasing force of the spring unit (32) impinging on the valve member (30) in the opening direction is variably adjustable via an actuator (52) that is adjustable by a thread (50).

13. The hydraulic drive according to claim 1, wherein the spring unit (32) impinging on the valve member (30) of the regulating valve (24) in opening direction is arranged on a side of the valve member (30) facing away from the pressure chamber (18).

14. The hydraulic drive according to claim 13, wherein a spring plate (54) having a diameter greater than a diameter of the valve member (30) is arranged on the side of the valve member (30) of the regulating valve (24) facing away from the pressure chamber (18) and the spring unit (32) impinging on the valve member (30) in the opening direction rests on the spring plate (54).

15. The hydraulic drive according to claim 14, wherein the spring plate (54) includes a spring cup (56) guided via the valve housing (28).

16. The hydraulic drive according to claim 1, wherein the spring unit (32) impinging on the valve member (30) of the regulating valve (24) in the opening direction is accommodated at least partly in the valve member (30).

* * * * *